United States Patent [19]

Pugh et al.

[11] Patent Number: 4,877,182

[45] Date of Patent: Oct. 31, 1989

[54] CRAWL SPACE VENTILATION SYSTEM

[75] Inventors: J. Robert Pugh, Greensboro; James F. Matherly, Summerfield, both of N.C.

[73] Assignee: Custom Industries, Inc., Greensboro, N.C.

[21] Appl. No.: 258,315

[22] Filed: Oct. 14, 1988

[51] Int. Cl.[4] ..... F24F 13/12

[52] U.S. Cl. ..... 236/44 C; 236/493; 98/33.1

[58] Field of Search ..... 236/49.3, 44 C; 98/32, 98/33.1; 165/16

[56] References Cited

U.S. PATENT DOCUMENTS

| | | | |
|---|---|---|---|
| 2,733,649 | 2/1956 | Le Barron | 98/33.1 X |
| 3,368,756 | 2/1968 | Edwards | 98/32 X |
| 4,178,841 | 12/1979 | Frank et al. | 98/98 |
| 4,251,026 | 2/1981 | Siegelebal | 236/49.3 |
| 4,290,554 | 9/1981 | Hensley | 236/49 |
| 4,407,187 | 10/1983 | Horney | 98/41 |
| 4,428,529 | 1/1984 | Bentsen | 98/32 X |
| 4,715,532 | 12/1987 | Sarazen et al. | 236/49 |

*Primary Examiner*—William E. Tapolcai
*Attorney, Agent, or Firm*—Rhodes, Coats & Bennett

[57] ABSTRACT

An automatically controlled, responsively to minimum temperature and humidity levels, ventilation system for crawl spaces beneath a house or other structure includes at least one intake unit and one exhaust unit. The intake unit includes at least one solenoid-operated ventilator and a temperature sensing device positioned to sense the temperature of outside air. The exhaust unit includes at least one solenoid-operated ventilator, a fan, and a remote humidistat positioned to sense the humidity level at a prescribed area of the crawl space. When the humidity rises above a prescribed level, the humidistat closes an electrical circuit to the thermostat. If the outside air temperature is above a prescribed level (at least above freezing), the thermostat closes the second circuit, energizing the solenoids and the fan. The solenoids cause the ventilators to open and the fan forces air through the crawl space to reduce moisture levels and dissipate any build-up of Radon gases beneath the structure.

6 Claims, 3 Drawing Sheets

CRAWL SPACE VENTILATION SYSTEM

BACKGROUND AND SUMMARY OF THE PRESENT INVENTION

The present invention is related to an automatically controlled ventilation system for providing a forced air exchange in the dead air spaces of a structure. Although such dead air spaces can exist in a variety of areas, the present system is particularly suited for use in the crawl space beneath a house or other structure where the building foundation raises the sub-floor above the ground.

Lack of sufficient ventilation and movement of air in such crawl spaces results in a build-up of excess moisture and also a build-up of Radon gases. Failure to dissipate such build-up leads to undesirable conditions such as pest problems, fungal growth, sweating and resultant damage to floor trusses and other structural components. Further, the humidity can invade the interior areas of the house, causing structural damage and/or growth of fungi or molds in the house. Heating and air conditioning loads are also increased by excess humidity levels.

Previous approaches to the control or elimination of such problems have been primarily related to installation of foundation ventilators, some of which open or close responsive to the temperature of outside air. Other approaches include the application of layers of polymeric materials over the earth within the crawl space. However, these materials do not inhibit the spread of moisture within the underlying dirt, and do not eliminate the problem. These layers of polymeric materials generally only delay humidity damage. Further, there is no effect on moisture which enters through open ventilators.

Regarding specific ventilator problems, most foundation-type ventilators are of the wire screen or mesh type and are closed either by the placing of a solid shield over the face of the ventilator, or by a shutter hingedly connected to the rear of the vent screen and pulled closed by means of a rod which extends outwardly from the shutter. Such structure is prone to failure because the screens puncture, the shutters fail to close, or do not close tightly, as a few examples only.

The present invention eliminates the above problems by provision of a unique forced air ventilation system and an improved ventilator. The air flow system itself includes an intake unit and an exhaust unit. The ventilator structure is of an improved sliding-plate-type having a solenoid control for opening and closing the sliding plate.

The intake unit of the ventilation system includes an intake ventilator positioned at a selected location in the foundation, and a temperature sensing device for sensing the temperature of the outside air. For example, it is undesirable to have the ventilator open when outside air is at sub-freezing levels because the admission of sub-freezing air can cause pipes to freeze and also increase the load on the furnace or other heating system. In the present system, when air temperature drops below freezing, the thermostatic control activates the solenoid to close the vent(s).

The exhaust unit also includes at least one solenoid-operated ventilator, a fan, and a humidity-sensing device. The humidistat is set to a predetermined humidity level and positioned in the area subject to the greatest humidity. When the humidity in this area rises above the prescribed level, the humidistat closes an electrical circuit, sending power to the thermostat. If, however, the outside temperature is below freezing, the thermostat will have relayed the signal, closing down the system, and the exhaust fans will not operate. Both the thermostat and the humidistat can be set to any desired level according to prevailing climatic needs. As stated above, the primary function of the thermostat is to prevent the introduction of sub-freezing air into the structural foundation. Thus, if the outside temperature is above freezing when the humidistat relays a signal to the thermostat, the thermostat will close the circuit and send power to the solenoid and the exhaust fan.

One advantage found is that the present invention permits the reduction of the number of ventilators necessary in a foundation wall because of the moving air. Therefore, there is less opportunity for cold air and moisture to enter the crawl space.

It was therefore an object of the present invention to provide an automatic system for ventilating the dead air spaces within a structure. It was a further objective to provide a ventilation system for crawl spaces, which system would function automatically, responsive both to humidity levels within the crawl space and to outside temperature.

Other and further objects will become apparent as the following detailed description is studied in conjunction with the following drawings.

DETAILED DESCRIPTION OF PREFERRED EMBODIMENT

Figure 1:
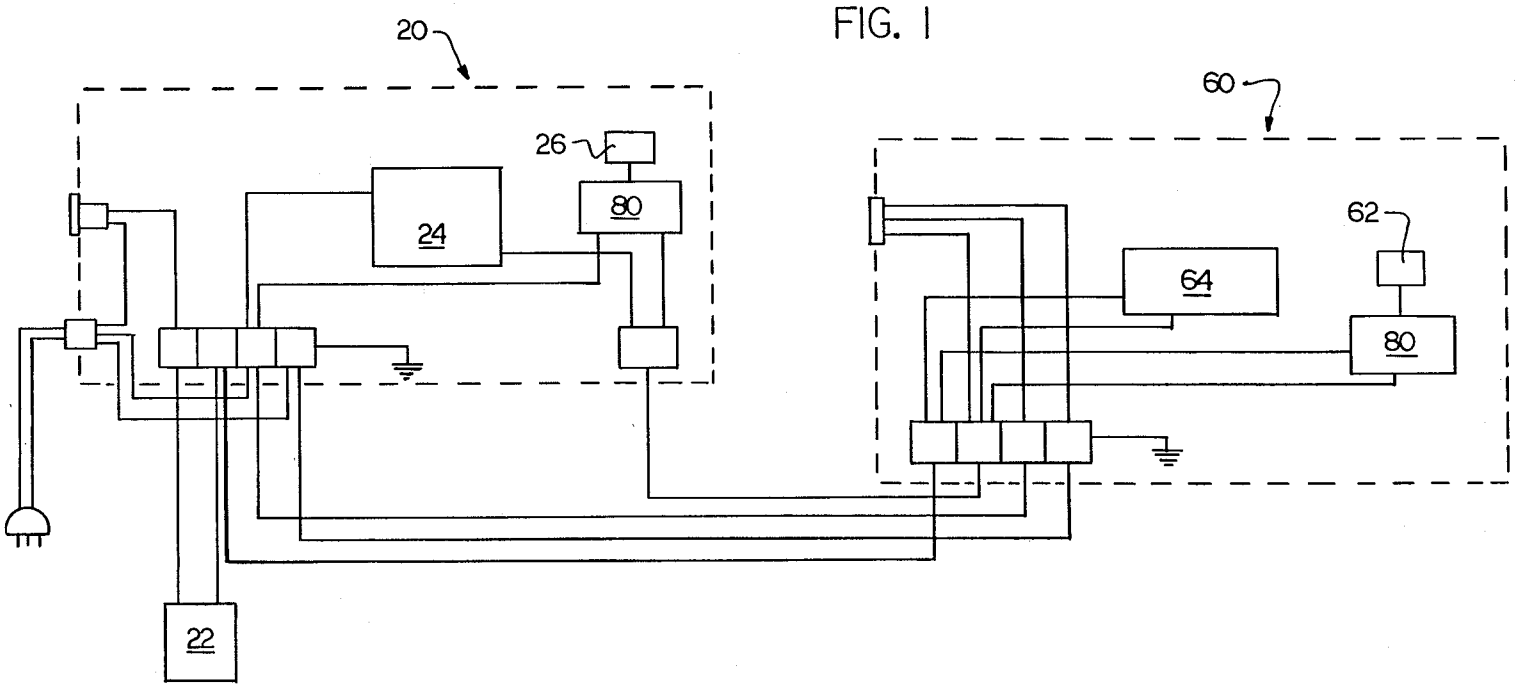
FIG. 1 is a schematic diagram of the ventilating system according to a preferred embodiment.
Figure 2:
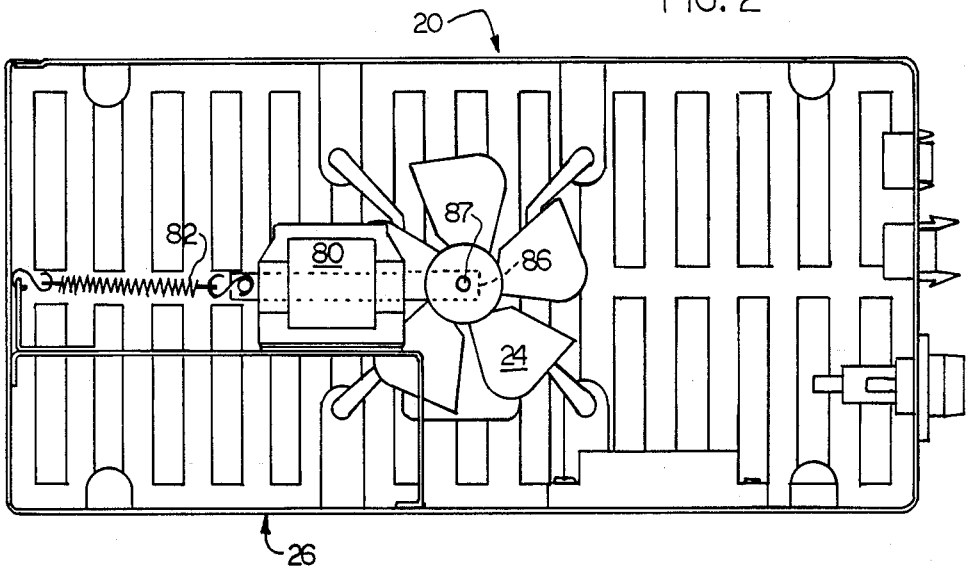
FIG. 2 is an elevation view, taken from the rear, of the exhaust apparatus.
Figure 3:
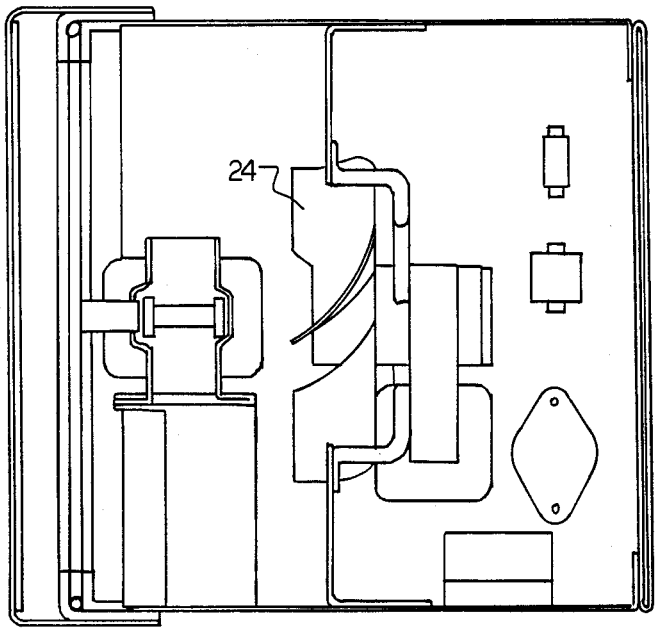
FIG. 3 is a side elevation of the exhaust apparatus of FIG. 2.
Figure 6:
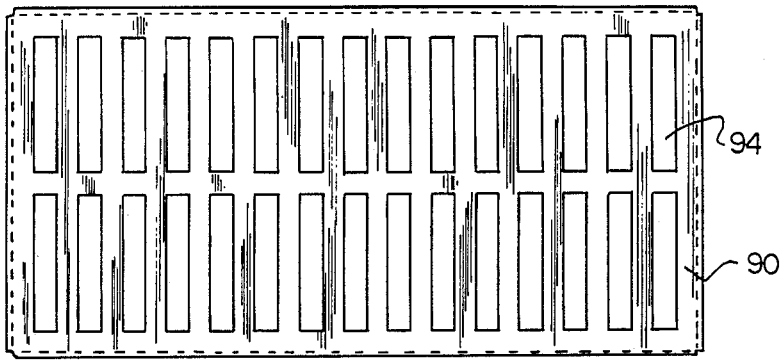
FIG. 6 is a plan view of the front or outwardly facing, stationary ventilator plate.
Figure 5:
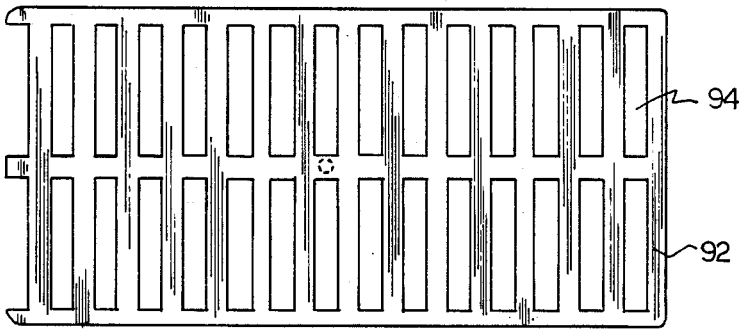
FIG. 5 is a plan view of the forward face of the rear, sliding venti-lator plate.
Figure 4:
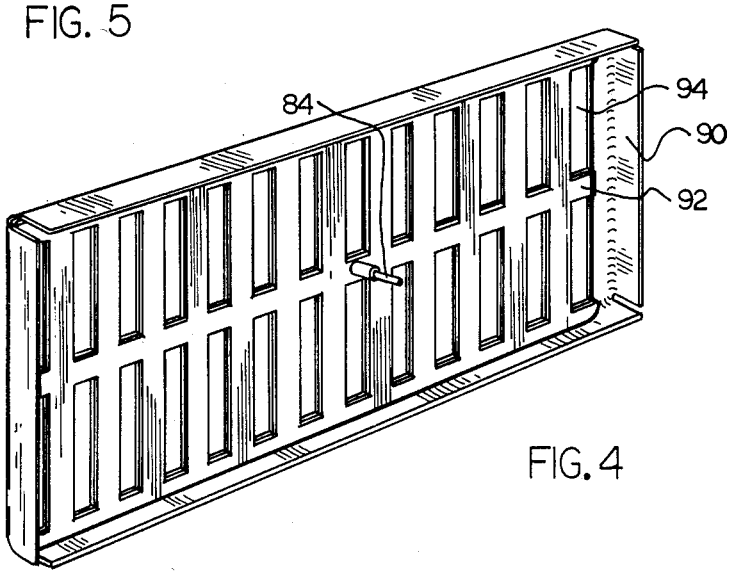
FIG. 4 is a rear perspective view of the ventilator utilized in the intake and exhaust systems, according to a preferred embodiment.

Looking first at the FIG. 1 schematic, there are two major units in the ventilation system of the present invention, the exhaust unit 20 and the intake unit 60. The exhaust unit 20 primarily functions to remove humid, stale air from the prescribed space and includes: a humidity sensing device 22, a fan 24 for pulling stale air out, and an exhaust ventilator 26. The intake unit 60 functions to draw in fresh, outside air and generally includes: an intake ventilator 62 positioned in the foundation outside wall, and a temperature sensing device 64 for sensing the temperature of the outside air. All ventilators, both intake and exhaust are controlled by solenoids 80.

As stated above in the summary, each of the intake and exhaust unit 20, 60 may include multiple ventilators 26, 62 dependent on the size of the area being ventilated. It is generally preferred to have at least 2½ to 3 exchanges of air per hour. However, while it is important that the exchange of air be at a level sufficient to dehumidify the crawl space, it is equally important that this be accomplished with a relatively low CFM of air movement in order to avoid creating a negative air pressure or draft situation. The creation of such drafts can interfere with pilot lights on furnace and/or hot water systems.

As illustrated, in FIG. 1, the system functions responsive to levels of both humidity and temperature of outside air. At ambient temperatures above freezing, the humidistat 22 controls operation. At temperatures below freezing, the thermostat 64 controls by cutting off the main power source. When this occurs, the circuit is closed to the solenoids, causing the intake and exhaust ventilators to close.

When temperatures are above freezing, and when the humidity in a prescribed area rises above a predetermined level, the humidistat 22 sends a signal to close the circuits to the solenoids, causing the vents to open, and also to the exhaust fan, causing the fan to cut on to pull the stale air out.

All ventilators 26 and 62 are opened and closed by a solenoid-controlled spring 82. Extension spring 82 is mounted between the solenoid 80 and a rearwardly extending push pin 84 attached to the rear face of the ventilator slide plate. The ventilators are each comprised of an outwardly disposed stationary plate 90, and a second, slidingly movable closure plate 92 mounted behind the stationary plate. Each of the plates 90, 92 include a plurality of vertically disposed elongated slots 94 therethrough. When the plates 90, 92 are contiguously positioned, the slots in plate 90 are out of alignment with the slots in plate 92 and the ventilator is thereby closed. No air moves therethrough. To open, solenoid 80 is activated to overcome compression spring 82, causing the second plate 92 to move laterally, sliding out of alignment with first plate 90, whereby the slots in each plate are aligned with each other, permitting air to flow through the ventilator.

As previously stated, the solenoid 80 is connected to push pin 84 on plate 92. The operative connection which causes the plate to slide is a solenoid plunger 86. One end of solenoid plunger 86 is operatively connected to the electrically energized coil within the solenoid. The opposite end of the plunger is included on aperture 87 through which the push pin 84 is mounted. When the coil in the solenoid is energized, the plunger is laterally displaced and pulls or pushes the sliding plate 92 into position to open or close the ventilator. A stop means within the solenoid controls the degree of plunger movement in one direction.

The intake and exhaust ventilators 62 and 26 are positioned within the exterior foundation walls at locations selected according to the desired air flow pattern. For example, the exhaust ventilator 26 should be positioned near or adjacent the areas of dampness or moisture collection. The exhaust fans associated with the exhaust ventilators are conventional, shelf-model exhaust fans chosen according to the size required to achieve the desired CFM movement.

The thermostat and humidistat are also conventional models selected according to specific installation requirements. Other and further modifications are also possible while remaining within the scope of the claims below.

What is claimed is:

1. A ventilation system for creating exhaustive air flow to ventilate the dead air spaces of a structure, such as within the crawl space beneath a house; said ventilation system comprising:

(a) an intake unit for movement of outside air into the area to be ventilated;

(b) an exhaust unit for exhausting air from the area being ventilated;

(c) means for controlling said intake unit and said exhaust unit in series relationship responsively to prescribed outside temperature and humidity levels within the space being ventilated, such that said system cuts off when outside temperature drops below a prescribed level; and when outside temperature is above said prescribed level, said system cycles on and off when humidity in the air space reaches a prescribed level.

2. A ventilation system according to claim 1 wherein said intake unit includes:

(a) at least one intake ventilator for movement of air from outside into the space being ventilated;

(b) means for closing said intake ventilator and cutting off of said ventilator system responsive to the temperature of outside air dropping below a prescribed level.

3. A ventilation system according to claim 1 wherein said exhaust unit includes:

(a) at least one exhaust ventilator for movement of air from within the space being ventilated to the outside;

(b) fan means for moving air through said exhaust ventilator;

(c) means for activating said fan means responsively to the humidity reaching a prescribed level in the space being ventilated.

4. A ventilation system according to claim 2 wherein said means for closing said intake ventilator and for cutting off of said system is comprised of a thermostat positioned to measure the temperature outside the space being ventilated.

5. A ventilation system according to claim 3 wherein said means for activating said exhaust fan means is comprised of an humidistat positioned such that said humidistat measures the humidity at a selected point in the area being ventilated.

6. A ventilation system for creating air in the dead air spaces of a structure, such as the crawl space beneath a house; said ventilation system comprising;

(a) an intake unit for pulling outside air into the area to be ventilated; said intake unit including:

(i) at least one intake ventilator for entrance of outside air to the area being ventilated;

(ii) means for opening and closing said intake ventilator responsive to temperature of outside air;

(b) an exhaust unit for exhausting air from the area being ventilated; said exhaust unit including:

(i) at least one exhaust ventilator for passage of exhaust air therethrough;

(ii) means for pulling exhaust air through said exhaust ventilator responsive to a prescribed humidity level within the area to be ventilated;

(c) means for controlling said intake and exhaust units in series relationship responsively to prescribed temperature and humidity levels such that said system cuts off when outside temperature reaches a prescribed cutoff point, automatically cycling on and off when the humidity reaches a certain level and the temperature is above said prescribed cutoff point.

* * * * *